United States Patent [19]

Arends

[11] 4,039,214

[45] Aug. 2, 1977

[54] DOOR OPENER

[76] Inventor: John M. Arends, 5023 S. 131st St., Omaha, Nebr. 68137

[21] Appl. No.: 614,221

[22] Filed: Sept. 17, 1975

[51] Int. Cl.[2] ..... E05C 21/02

[52] U.S. Cl. ..... 292/336.3; 292/DIG. 37

[58] Field of Search ..... 292/DIG. 37, 166, 168, 292/221, 227, 127, 336.3

[56] References Cited

U.S. PATENT DOCUMENTS 567,063 9/1896 Alfors ..... 292/DIG. 37

FOREIGN PATENT DOCUMENTS 474,641 11/1937 United Kingdom ..... 292/166

*Primary Examiner*—Richard E. Moore

[57] ABSTRACT

A door opener for control of a door latch spindle comprising a body containing a wrench for rotating the spindle, the body having a plunger extending therethrough and adapted to be pressed to control the wrench, the opener being a substitute for a door knob and its body having a finger-receiving recess so that the body can be pulled to open the door.

9 Claims, 8 Drawing Figures

DOOR OPENER

FIELD OF THE INVENTION

This invention is in the field of door spindle actuators attachable to doors of the type having latches which can be caused to reciprocate by the rotation of a spindle extending horizontally from the door and to which a knob is customarily attached.

DESCRIPTION OF THE PRIOR ART

The rotation of spindles has most commonly been done by means of the common door knob. But a door knob is slippery when the hands are soapy and its rotation is difficult, also, for small children who have dry hands.

When levers are used in a substitute for the common knob, they are usually less attractive than could be desired. In addition, levers permit the application of such a torque on a spindle that it is possible for a spindle to break in two and greater durability is desired together with a spindle actuator that can be operated by a simple pressure.

There have been times in the past when a spindle actuator has been proposed which is substantially only adapted to receive pressure from the thumb, whereas the pulling force is applied to a separate handle. Greater attractiveness is desired, which I believe to be achievable by making the pressure plunger reciprocate in a body or housing which itself functions as a handle for the pulling of the door open.

One of the great needs of the prior art is for variety in door openers. Refreshing change and newness is needed in appearance, in my opinion, and also newness in a method of actuation.

SUMMARY OF THE INVENTION

A door opener for control of an elongated door latch spindle, the spindle being either provided with a portion which is square on its periphery in cross-section, or else one that is, in some manner, non-round on its periphery, the opener comprising a body having a cavity, a wrench in the cavity, and receiving the non-round spindle portion therein and being adapted to apply torque thereto when the wrench is rotated in a vertical plane, a plunger reciprocating through an opening in the body, means pivotally connecting the plunger and the wrench in a manner whereby inward movement of the plunger causes the wrench to rotate for applying torque to the spindle so as to open a door to the latch of which the spindle is attached, the body having a rearward side having rearwardmost portions disposed in a vertical plane for engaging the vertical side of a door, is the main objective of the invention.

A second objective is to provide an opener having the same body description as above, but which further has a finger recess so that the fingers of the operator can be placed in the recess for engaging a wall of the recess so that the body can be easily pressed for its use as a handle to open the door.

A further objective is to provide the body with a sufficient size for covering conventional openings in doors as they are generally manufactured.

A further object is to provide a door opener the plunger of which will be caused to return to a rest position by the effect of the conventional spring that causes a spindle of conventional type to return to rest position when a conventional knob is released, as is possible since the wrench rotates whenever the spindle rotates and the plunger reciprocates whenever the wrench rotates.

A further object is to provide the opener with a special spring mounted in its cavity in a position for urging movable parts of the door opener, such as the plunger itself, toward a rest position.

Another object is to provide a door opener that has an attractive round base as seen from the front to contrast with the straight rectangular lines of the door and which further has a plunger-receiving body portion adapted to serve as a handle which is relatively more rectangular when seen from the top or sides so as to exhibit straight lines for contrast with the circular portion of the body.

DESCRIPTION OF THE PREFERRED EMBODIMENT

Figure 2:
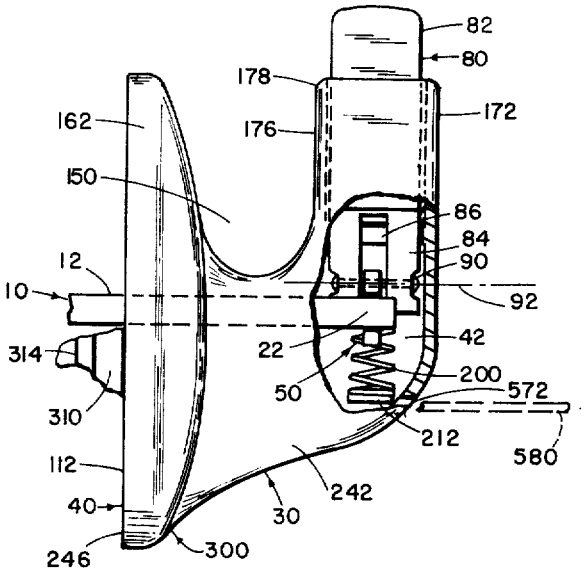
FIG. 2 is a right side elevation of the door opener of FIG. 1 with a portion of the body or housing broken away to show parts therebehind.

Referring to FIG. 2, a door, a door latch and door latch control spindle assembly is generally indicated at 10, although the only part of the assembly that is shown is the spindle itself, which is seen at 12, since the other parts are conventional to doors having knobs.

Figure 1:
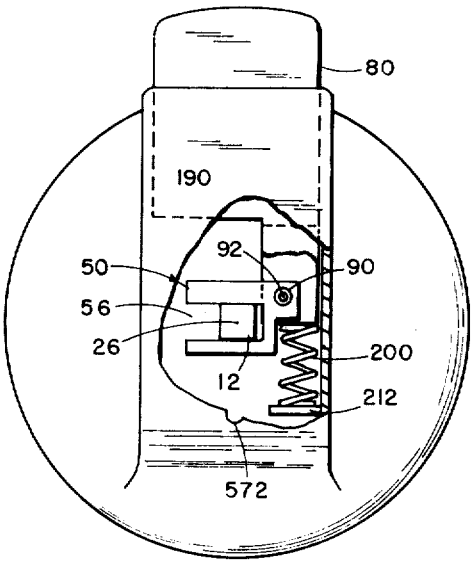
FIG. 1 is a front elevation of the door opener of this invention, shown with a portion thereof broken away at the exterior and another portion of the interior broken away to show parts therebehind., and shown with a portion of a door to which it is attached, a portion of a door latch housing, and a portion of a door latch being shown in the door.

The spindle 12 is of square shape in cross section, as best seen in FIG. 1, and is for purposes of this invention of at least some cross sectional shape that is non-round, at least on a portion thereof that can be called a control portion, and generally indicated at 22, whereby it has a periphery that is non-round in cross section and preferably square.

It is to be understood that the spindle 12 when rotated in either direction about its axis 26 will cause a door to unlatch in a conventional manner, such as is shown in U.S. Pat. No. 71123, titled "Latch", issued Nov. 19, 1867 to N. Belrallette.

Similar control of a door latch by means of a spindle can be found in U.S. Pat. No. 3,287,054, issued to F. J. Russell et al, issued Nov. 22, 1966, titled "Spindle Rotating Pull Means".

The spindle 12 is controlled in accordance with this invention by a door opener 30, comprising a body 40, having a cavity 42, receiving a wrench 50, having an opening 56 therethrough, in which the portion 22 of the spindle is received.

The walls of the wrench 50 which are at the opening 56 grip the spindle 12, preferably on two sides as shown, whereby when the wrench 50 is caused to rotate in a vertical plane, the spindle will be forced to rotate about its axis 26 for retracting the door latch, not shown.

The body 40 has a plunger opening 72, extending from its exterior to the cavity 42, and a plunger 80 is slidably mounted in the opening 72, the plunger having an exterior portion 82 when the parts are in rest position, and an interior portion or inner portion 84, the parts of which are preferably separated by a slot 86, between which the wrench 50 is received, the wrench being pivotally connected by a pin 90 to the inner portion 84 of the plunger for rotation of the wrench about a horizontal axis extending through the center of the pin 90, whereby it can be said that the pin 90 mounts the wrench 50 in a manner for rotation about a horizontal axis 92, as seen in FIG. 1.

The outer portion 82 of the plunger protrudes slightly from the body, even when the plunger 80 is pushed in to the maximum, and the plunger 80 protrudes from the body a greater extent when the parts are at rest position, such as when no torque is being applied to the spindle 12.

The body 40 has a rearward side, generally indicated at 112, and the rearward side 112 has rearwardmost portions disposed in a vertical plane for engaging a flat door surface that is vertical.

The rearward side 112 is provided with a spindle opening 142 therethrough, which extends horizontally and opens onto the cavity 42.

As best seen in FIG. 2, the body 40 has a recess 150 in the upper side thereof and particularly in any side thereof other than the forward side, which engages the door. The recess 150 is for receiving the operator's fingers and is formed between the base portion of the body 162, which is preferably of circular shape in frontal or rearward elevation, and a protrusion or handle portion 172 of the body 40 which extends in its lower part forwardly from and is attached to the base portion 162 of the body and extends upwardly and is spaced from the base portion 162 by the finger recess 150, whereby the operator's fingers can engage the forward side 176 of the protrusion 172 at the same time as the plunger 80 is pushed downward, whereby pressure against the surface 186 of the handle or protrusion 172 can be used to pull the door open.

The outer end 178 of the protrusion 172 is upwardly extending because it is believed convenient for both right handed and left handed people and also children to reach up over the protrusion or handle for using it to pull the door open.

Figure 3:
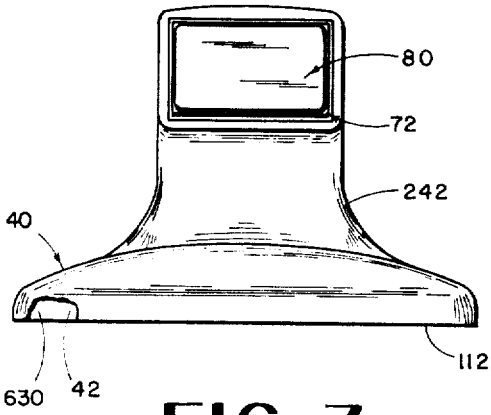
FIG. 3 is a top plan view of the door opener of this invention.
Figure 4:
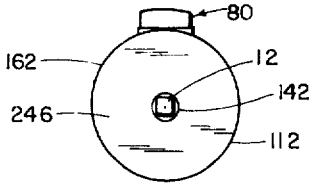
FIG. 4 is a rearward side elevation of the opener of this invention.

The opening 72, seen in FIG. 3, is preferably of a non-round shape, adapted to sufficiently closely fit the non-round shape of the periphery of the plunger 80, as seen in top plan view, so as to prevent rotation of the plunger 80 and to confine its motion to being only upwardly and downwardly, by sliding only linearly of the body 40.

The plunger 80 has a recess 190 in its left hand side, as shown in FIG. 1, so that no part of the plunger 80 is in a position for interfering with the free rotation of the wrench 50.

The axis 92 is disposed to the right hand side of the center of the plunger top portion 82, because of the need for the recess 190 to permit the wrench to rotate.

Referring now to FIGS. 1 and 2, a spring 200 is there shown, having its lower end rested on a shelf 212, fixed to the body 40, and the upper end of the compression spring 200 engages the lower side of the plunger 80, so as to cause it to be urged into an upper position, whenever it it is not being pressed. However, it is to be understood that the spring 200 ordinarily would not be needed because there is a spring that is conventional in door latch and spindle assemblies, which tends to cause a door latch to seek a rest position that is extended with respect to a door and simultaneously also causes a spindle to seek a certain rest position, which latter would be the position in which the spindle 12 is shown in FIGS. 1 and 2, whereby the conventional spring, not shown, of a conventional door latch and spindle assembly, mostly not shown, is ordinarily sufficient to cause all parts to seek their retracted and rest positions.

However, some may prefer to use an additional spring, and, if so, the position of the spring 200, as shown, is effective for the purpose of assisting the conventional spring, not shown.

In operation a person simply presses down on the plunger 82, at the same time allowing his fingers to slide past the forward surface 178 of the protrusion 172, whereby pressure against the surface 178 will make the door easy to open, since downward movement of the plunger 80 will have caused the wrench 50 to rotate in the recess 190 for rotating the spindle and retracting the latch, not shown.

It is important that there be a sufficient looseness of parts to allow the pin 90 to move straight downwardly with respect to the axis 26. This is accomplished by providing the spindle recess 56 in the wrench 50 with a sufficient depth that the wrench can slide with respect to the axis 26 along with surfaces of the spindle and in directions normal to the axis 26 as the plunger 80 moves downward.

The upwardly extending portion 176 of the handle or protrusion 172 is supported by a generally horizontally extending portion 242 of the protrusion, which attaches it to the base portion 162, all in a durable and attractive fashion.

The body 40 can be secured to the remainder of the door opener, door latch and door assembly 300 in many ways and so none is illustrated here except, since it is simple to illustrate, glue 246 may be put on the forward side 112 securing it to the door.

In FIG. 2 a portion of the door is seen at 310, a portion of a conventional door latch housing at 312, and a portion of a latch thereof at 314.

A beautiful and refreshing door opener is thus provided.

The base portion 162 of the door opener is of substantially greater width, as seen in frontal elevation, than the outer end of the handle protrusion 172, whereby the base portion is adapted to cover a large circular opening, not shown, frequently existing in conventional doors. It is preferred that the base portion width be approximately double the width of the upper portion or outer end of the handle protrusion 172. The base portion 162 is circular as seen in frontal elevation since such openings in doors are usually circular. The base portion 162, therefore, has a periphery of approximately 3 inches. The drawing is shown in full scale with the base portion 3⅛ inches in diameter.

Figure 5:
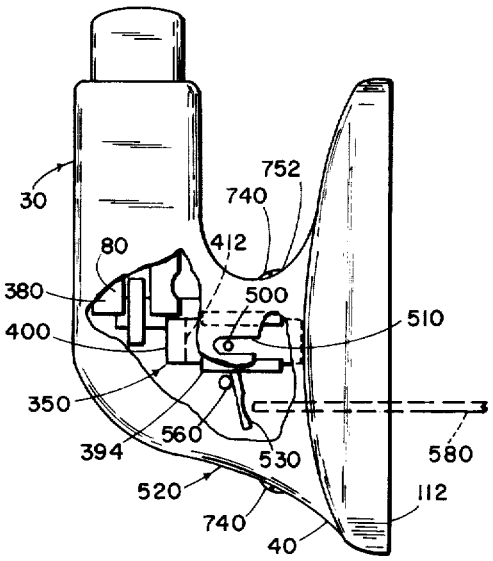

A locking mechanism is generally indicated at 350 in FIG. 5 for the purpose of locking the door opener 30. The plunger 80 and the wrench 50 together define a plunger and wrench assembly 390.

A locking mechanism or lock assembly 380 has a track 394 mounted on the inside of the body 40 in the cavity 42 and attached to the body 40. A bolt 400 is slidably mounted in the track 394 for sliding forwardly and rearwardly, when it is understood that the rearward side of the body 40 is shown at 112 and is the side which faces the door. When the bolt 400 is in a forward position it is disposed under the plunger 80 so that the plunger 80 is prevented from moving downwardly to unlock the door. In a larger sense the bolt 400 is at that time in a locking position disposed under some part of the plunger and wrench assembly 390.

The bolt 400 is also slidable rearwardly into an unlocking position with its forward end in the dotted line position shown at 412 in FIG. 5 in which the plunger 80 is free to move downwardly and unlock the door.

A manually operated bolt control can be seen at 500 and protrudes outwardly through a bolt control opening or slot through the body 40, whereby the control 500 can be manipulated by an operator from the exterior of the body 10 so as to slide it forwardly and rearwardly. Since the bolt control 500 is attached to the bolt 400, it can be used to move the bolt 400 from the locking to the unlocking positions because of the adequate size of the opening or slot 510.

Figure 6:
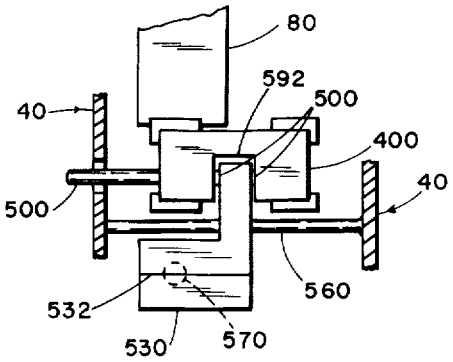

The bolt 400 and track 394 and body 40 define a body, bolt and track assembly 520, shown in FIG. 5. A trigger 530 is provided and is movably mounted on the latter assembly 520 in a manner whereby pressure on the rearward side of the trigger 530 will cause the trigger to move forwardly at its lower end and rearwardly at its upper end in a manner for moving the bolt 350 into the unlocking position with its forward end at 412. This is accomplished by having the trigger 530 bear against a fulcrum pin 560 which is fixed to the body 40 at each of its ends with the pin 560 being cylindrical and extending from one of its ends to the other between two opposite side walls of the body 40, as best seen in FIG. 6, so that it is there fastened to the body 40 and fixed in position.

The trigger 530 has a recess 532 to facilitate its being engaged by the forward end of an elongated opening pin 570 which is used by an operator to extend horizontally through the rearward side 112 of the body 40 by passing it completely through the door as is accomplished by having an opening 572 in the body 40 of that door opener which is on the opposite side of the same door. Therefore, the opening 572 can be seen in FIGS. 1 and 2, which can be viewed on the door opener on the outside of a door; whereas the door opener of FIG. 5 is a door opener on the inside of the same door.

The emergency opening pin for pressing on the trigger 530 is best seen at 580 in dotted lines extending through the opening 572 in FIG. 2 and it extends along side the spring 200 and its base 212. The emergency opening pin 580 can also be seen in FIG. 5 extending through an opening 584 in a special attachment assembly 600 and, therefore, in engagement with the rearward side of the trigger 530 by extending through the door itself.

The trigger 530 has its upper end received in a notch 592 in the underside of the bolt 400 and it is attached in a pivotal manner to the bolt 400 by an extension of the control member 500 which extends through the bolt 400.

As thus described pressure on the rearward side of the trigger 530 by the emergency pin 580 will cause the lower end of the trigger to move forward and the upper end of the trigger to move rearwardly because of the fulcrum 560, thereby causing the lock 400 to move rearward and into an unlocking position.

Figure 7:
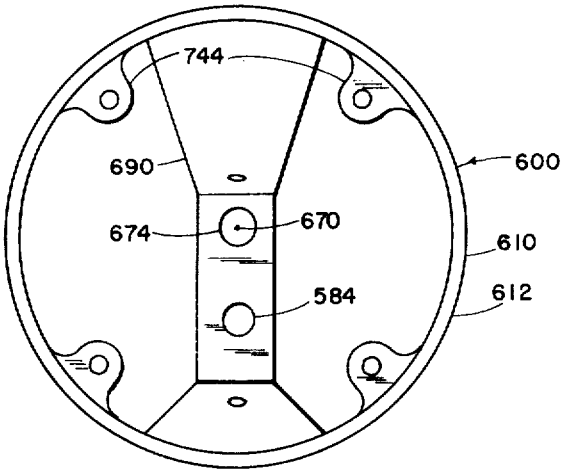

Referring to FIG. 7 an attachment assembly 600 is there shown which has a frame 610 which is of circular shape on its exterior and is of a size for snugly receiving the cylindrical inner surface 630 of the cavity 42 of the body 40, as best seen in FIG. 3. Since the outer surface 612 of the base of the frame 610 is also cylindrical on a same axis with the cylindrical configuration on which the surface 630 is disposed, both cylindrical surfaces being centered about an axis 670, seen in FIG. 7, which extends through a hole 674 in a center webb 690 of the frame 610 of the attachment assembly 600. The hole 674 serves to receive therethrough the spindle 12, as seen in dotted lines in FIG. 8.

Figure 8:
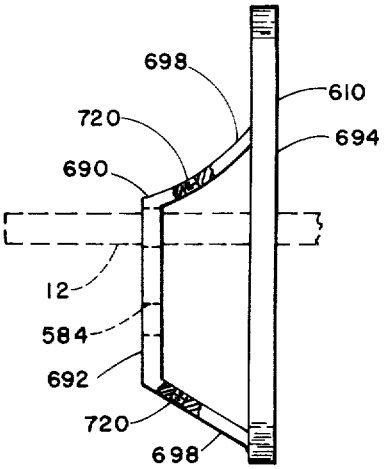

The center webb 690 has a forward portion 692, which is flat on its rearward and forward sides and disposed in parallelism with the planar configuration in which the rearward edge of the frame 610 lies, such rearward edge being shown at 694 in FIG. 8.

The webb 690 has rearwardly extending legs 698 on its upper and lower sides which attach it to the base 612 of the frame 610.

Two threaded set screw holes 720 are provided, one in each of the legs 698, and the holes 720 threadedly receive set screws which latter extend through the body 40 to attach the body 40 to the legs 698, said set screws being seen in FIG. 5, at 740.

Since the attachment assembly 600 has perforated ears extending inwardly from its base 612, such ears being shown at 744. Therefore, it will be understood that common screws extending through the ear 744 can attach the frame 610 to a door securely and that the body 40 can be removed from the attachment assembly 600 whenever desired by loosening the set screws 740, which latter extend through openings 752 in the body 40 of the respective door opener.

I claim:

1. A door opener for control of an elongated door for control of an elongated door latch spindle which extends horizontally and is mounted to rotate about a horizontal axis, said opener comprising: a body having a cavity, said body having a plunger opening extending from its exterior to said cavity, a plunger slidably mounted in said plunger opening, said plunger having an inner portion, means operably correlating said inner end of said plunger and said spingle in a manner whereby inward movement of said plunger is not applying torque to said spindle, said body having a rearward side, said body having a spindle opening in its rearward side extending from the exterior to said cavity, said body having a rearward side surface having rearwardmost portions in a vertical plane for engaging a door, said spindle being of a type having a portion which has a non-round periphery in cross-section, said correlating means comprising a wrench in said cavity, said wrench having an opening for receiving said spindle portion, the walls of said wrench opening gripping said spindle when said wrench is caused to rotate in a vertical plane, means pivotally connecting said inner portion of said plunger to said wrench in a manner whereby inward movement of said plunger causes said wrench to rotate in a vertical plane.

2. The door opener of claim 1 having said body having a recess on a side thereof other than said forward side into which an operator's fingers can be inserted, said body having a handle protrusion having a surface facing generally rearwardly and disposed at a rearward side of said recess and adapted to be pressed by an operator's fingers for pulling said door open.

3. The door opener of claim 2 having the outer end of said handle protrusion upwardly-extending.

4. The door opener of claim 1 having the periphery of said plunger being non-round in transverse cross section, said plunger being slidable in said body substantially only linearly of itself.

5. The door opener of claim 2 having said body having a base portion of substantially greater width as seen in frontal elevation than the outer end of said handle protrusion for covering a large opening frequently existing in conventional doors.

6. The door opener of claim 2 having said body having a base portion of substantially greater width as seen in frontal elevation than the outer end of said handle protrusion for covering a large opening frequently existing in conventional doors, said base portion width being approximately double the width of the outer end of said handle protrusion.

7. The door opener of claim 2 in which said body has a base portion of substantially circular shape and of substantially three inches in diameter.

8. The door opener of claim 1 in which said plunger and said wrench define a plunger and wrench assembly, a locking mechanism having a track mounted on the inside of said body, a bolt slidably mounted in said track and slidable into a locking position for engaging and blocking said plunger and wrench assembly as it moves from rest position to door unlocking position so as to prevent door opening movement of said assembly, said bolt also being slidable into an unlocking position of non-blocking relationship with said assembly, a manually operable bolt control connected to said bolt, said body having a bolt control opening therethrough and through which said control extends, said bolt control opening permitting movement of said bolt control between positions for causing said bolt to lock and to unlock said door opener.

9. The door opener of claim 8 in which said body, bolt and track define a body, bolt and track assembly, a trigger, means movably mounting said trigger on said latter assembly in a manner whereby pressure on the rearward side of said trigger will cause said trigger to move in a manner for moving said bolt into said unlocking position.

* * * * *